US005743161A

United States Patent [19]

Boudreau

[11] Patent Number: 5,743,161

[45] Date of Patent: Apr. 28, 1998

[54] ANGULARLY ADJUSTABLE TABLE SAW JIG

[76] Inventor: Jon P. Boudreau, 35 Garrison Ave., Somerville, Mass. 02144

[21] Appl. No.: 770,681

[22] Filed: Dec. 17, 1996

Related U.S. Application Data

[63] Continuation of Ser. No. 508,379, Jul. 31, 1995, abandoned.

[51] Int. Cl.[6] ..... B27B 25/08; B27B 27/06; B26D 7/01

[52] U.S. Cl. ..... 83/435.11; 83/477.2; 83/478; 83/581; 83/544; 269/315

[58] Field of Search ..... 83/581, 477.2, 83/478, 435.1, 437, 468.3, 544, 860; 269/303, 315

[56] References Cited

U.S. PATENT DOCUMENTS

| | | | |
|---|---|---|---|
| 1,092,518 | 4/1914 | Brooks | 83/437 |
| 2,435,382 | 2/1948 | Caskey | 83/435.1 |
| 2,731,049 | 1/1956 | Akin | 83/478 |
| 2,894,543 | 7/1959 | Ivy, Jr. | 83/437 X |
| 2,905,210 | 9/1959 | Thomas | 83/435.1 |
| 3,105,528 | 10/1963 | Loughridge | 83/468.3 |
| 3,986,420 | 10/1976 | Huntley, et al. | 83/435.1 |
| 4,111,409 | 9/1978 | Smith | 83/435.1 X |
| 4,206,672 | 6/1980 | Smith | 83/435.1 X |
| 4,441,394 | 4/1984 | Barsotti | 83/435.1 X |
| 4,603,612 | 8/1986 | Atkins | 83/425 |
| 4,604,612 | 8/1986 | Atkins | 83/435.1 X |
| 5,116,249 | 5/1992 | Shiotani et al. | 83/435.1 |
| 5,338,014 | 8/1994 | Kitamura | 269/303 X |

*Primary Examiner*—Rinaldi I. Rada
*Assistant Examiner*—Elizabeth Stanley
*Attorney, Agent, or Firm*—O'Connell Law Firm

[57] ABSTRACT

An angularly adjustable table saw jig which comprises a base plate having an upper flat surface for supporting a work piece to be cut, a means for slidably attaching the jig to a table cutting tool, an upwardly extending work advancing abutment rotatably connected to the base plate at an axis of rotation for advancing work into cutting engagement with a table cutting blade, and a slot extending generally parallel to a cutting path of the cutting blade for providing clearance for the cutting blade as the jig is advanced into cutting engagement therewith. The jig also includes an elongated guide rail, which is rotatably connected to the base plate, and whose axis of rotation lies in the same plane of the cutting blade. The jig may include further a shield for preventing undesirable access to a spinning saw blade and for preventing injury from flying debris, a work piece restraining means for preventing movement of work pieces and resultant inaccurate cutting and injury, and a safety cutoff means for preventing power from flowing to the table cutting tool when the operator's hands are not located properly.

20 Claims, 3 Drawing Sheets

ANGULARLY ADJUSTABLE TABLE SAW JIG

This application is a continuation of application Ser. No. 08/508,379 filed on Jul. 31, 1995, now abandoned.

FIELD

The present invention relates to devices for guiding work pieces into the cutting tool of table saws. More particularly, it relates to a jig of improved safety which is capable of convenient and infinite adjustment over a wide range of cutting angles.

BACKGROUND

A table saw normally includes a cutting tool which projects from a base table. The cutting tool often is a rotary saw blade. In use, the saw blade spins quickly enough to saw through metal, wood, and the like. Operators of tables saws can align and feed work to the cutting blade by hand. However, doing so is unsteady, inaccurate, and dangerous. Though useful, the rotary action of the blade presents dangers to the fingers, eyes and loose clothing of the user.

Previous inventors have disclosed guides, jigs and other attachments for table cutting tools seeking to make the cutting of work pieces to desired lengths and angles safer and more accurate. For example, Barsotti invented a "Table Saw Guide Apparatus" which was issued as U.S. Pat. No. 4,441,394. Barsotti's guide includes an adjustable gauge device for aligning work pieces to be cut. The gauge device resides very near the rotary cutting blade and leaves the spinning blade exposed and projecting well above the gauge device. As a result, this prior art invention confronts the user with the need to adjust the angle of the gauge device in close proximity to what may be a rapidly spinning serrated cutting blade. Also, with the cutting area exposed, there is a danger of debris and work pieces or portions thereof flying up and striking the user. Furthermore, the accessibility of the cutting area may tempt the operator to reach in to restrain errant work pieces.

Inventor Smith apparently recognized the dangers presented by the class of table saw devices which leave the operator exposed to the cutting blade, and he has been issued two patents in this area: U.S. Pat. Nos. 4,111,409 and 4,206,672. Together, these patents disclose a cutting tool jig which advances work into the cutting blade by means of a base plate and a work advancing abutment. The device further includes a pair of parallel plates which may be lowered to straddle the cutter blade to give some degree of protection to the operator and to restrain work pieces.

While the parallel blades of Smith have made some progress toward making table saw attachments safer, they merely sandwich the spinning blade. Consequently, the blade remains exposed and accessible, and users have the unfortunate ability to touch the cutting blade while it is in motion. Furthermore, debris from the sawing operation still are able to eject from the cutting area to injure the user. In addition, the Smith invention employs a multiplicity of flat plates for altering the bevel angle to be cut by the cutting blade. Consequently, every angle requires its own plate, and changing the angle to which a work piece will be cut requires removing the existing plate and substituting and adjusting a new one. As a result, angular adjustment is difficult and time consuming, and the number of angles which the user can cut is limited by the number of plates one is willing to obtain and transport with the jig.

Due to the aforementioned and other deficiencies in prior art devices, specialized miter cutting tools have continued to be the tools of choice for craftspeople since they quickly and accurately cut work pieces to desired angles. However, such tools are expensive, are cumbersome to carry to and from work sites, and generally cannot cut work pieces to consistent lengths and angles without repeated measurement and adjustment.

In light of the above, there is a need left by the prior art for a table saw jig of improved safety which is easily operated and is easily adjusted to a wide range of angles such that it would improve on and supplant specialized miter cutting tools without any sacrifice in performance.

SUMMARY

With the foregoing in mind, the principal object of the present invention is to provide a table saw jig which is safer, easier to operate, and more easily adjustable to a wide range of angles than prior art devices.

More particularly, it is an object of the present invention to provide a table saw jig capable of infinite adjustment about a wide range of cutting angles.

An additional object of the invention is to provide a table saw jig which measures and cuts work pieces simply and accurately.

It is another object of the invention to provide a table saw jig with improved safety over prior art devices by providing a shield means capable of protecting the operator against the dangers of the spinning cutting blade and debris flying from the cutting area.

Still another object of the invention is to provide a table saw jig with improved accuracy and safety over prior art devices by providing a work piece restraining means for avoiding unwanted movement of work pieces.

Another object of the invention is to provide a table saw jig which provides accurate and consistently repeatable length measurement for work pieces to be cut.

Yet another object of the invention is to provide a table saw jig of improved safety by providing a safety cutoff mechanism which prevents operation of the cutting blade when the operator's hands are not located properly.

A further object of the invention is to provide a table saw jig which supplants the need for a specialized mitering tool by performing equivalent functions with improvements in efficiency and safety.

Another object of the invention is to provide a jig which may be adjusted for use on a wide range of table cutting tools.

From this specification, these and other objects and advantages of the present invention will become obvious to those skilled in the art. In carrying out the aforementioned objects, the present invention comprises essentially a base plate having an upper flat surface for supporting a work piece to be cut, a means for slidably mounting the jig to the table, a guide rail rotatably connected to the base plate for advancing work into the cutting blade, and a slot in the base plate which communicates along the path of sliding engagement of the jig with respect to the cutting blade. By rotating the guide rail with respect to the path of the cutting blade and advancing the jig into cutting engagement with the cutting blade, an operator can adjust the angle to which a work piece will be cut infinitely over a wide range of angles.

The means for slidably mounting the jig to the table may comprise one or more ridges attached to the bottom of the base plate, the ridges being attached parallel to the cutting path of the cutting blade. The ridge(s) may be adjustable laterally to align with channels of the type which are commonly included in the tops of table saws. One should note that, while the invention is disclosed with guide ridges acting as the means for slidably mounting the jig to the table saw, those skilled in the art can imagine multiple other equivalent means. For example, the jig could be crafted to slide, not along the table saw channels, but instead along the edges of the table saw upper face.

For added safety, embodiments of the invention optionally may include an elevated shield. The shield may be connected to the base plate or the guide rail. It may be advantageous to make the shield, or at least a portion thereof from a substantially transparent material to allow the craftsperson to monitor the progress of the cutting blade. While it may be permanently connected at both ends, the shield instead may have one end connected by a hinge means and its other end detachably connected. With this, a user could rotate the shield to an open position for easier access to the work piece when the blade is not in motion.

One may note that the shield provides improved safety over prior art devices. In prior art inventions, access to the spinning cutting blade has been unfortunately convenient and the problem of flying debris has been addressed inadequately. In the instant invention, the shield blocks flying debris such as chips of metal and sawdust from flying into the user's eyes. Furthermore, the shield restricts both the user and the user's loose clothing from entering the cutting area. By use of the present invention, lost fingers and damaged eyesight will be avoided.

To add to the protection provided by the shield, the device may include a safety cutoff means. The cutoff means may be of any suitable type which ensures that both of the user's hands are located on the jig and away from the cutting blade before the cutting blade may turn. The cutoff mechanism contemplated for the preferred embodiment is one in which the power supply to the saw passes through the jig such that the jig acts as an intermediary between the power source and the table saw. With a work piece in place, a user must squeeze two triggered handles to complete the electrical circuit and to allow power to flow to the table saw. With both hands taken up squeezing the triggers, the user is precluded from placing his or her fingers near a powered saw blade.

Errant work pieces are of significant concern also. An unrestrained work piece may be cut inaccurately and is prone to flying up from the work area. However, restraining work pieces by hand can be dangerous. Therefore, to ensure accurate, safe cutting, the jig may include further a means for restraining work pieces such as an extensible and retractable rod projecting down from the shield for engaging the work pieces. Alternatively, the restraining means may depend off of the guide rail.

The functionality of the device may be improved further by the provision of accurate and consistent measuring means. For example, the device may include angular incrementation disposed on the base plate so a user can measure miter angles quickly and accurately. Further, the device may include length measuring and controlling means such as a guide stop on the guide rail which may be slid along incrementation disposed on the guide rail and locked in place at a desired length increment. Having done so, the work piece to be cut may be butted up against the guide stop to achieve accurate and repeatable length measurements.

The foregoing discussion broadly outlines the more important features of the invention to enable a better understanding of the detailed description that follows and to instill a better appreciation of the invention's contribution to the art. Before an embodiment of the invention is explained in detail, it must be made clear that the following details of construction, descriptions of geometry, and illustrations of inventive concepts are mere examples of possible manifestations of the invention.

REFERENCE NUMERALS

Figure 1:
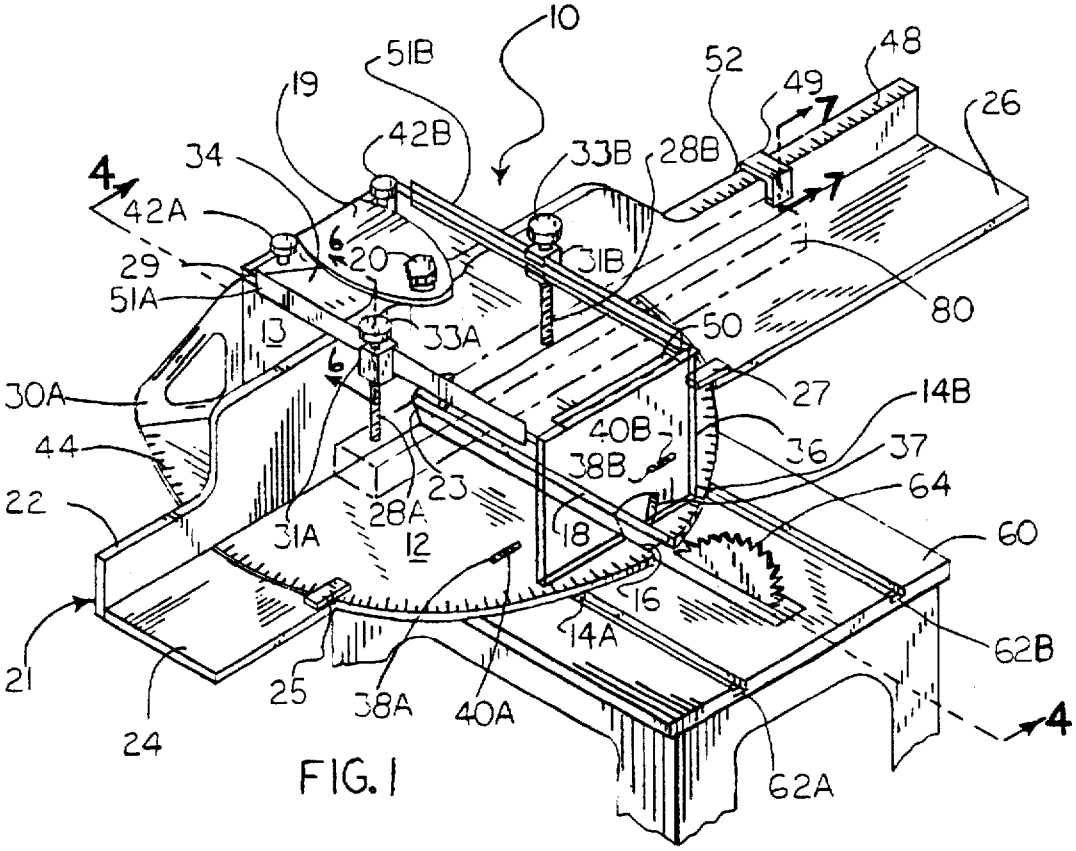
FIG. 1 is a perspective view of a preferred embodiment of the jig invention, the jig being mounted on a table rotary cutting tool.

In the accompanying description and in the included drawings, the reference numerals are applied as is shown below.

| | |
|---|---|
| 10 | jig |
| 12 | base plate |
| 13 | inner base triangle |
| 14A & 14B | guide ridges |
| 15 | front of base plate |
| 16 | side of slot |
| 17 | tunnel in triangle |
| 18 | side of slot |
| 19 | axis retaining tongue |
| 20 | axis bolt |
| 21 | guide rail |
| 22 | work advancing abutment |
| 23 | tunnel in work advancing abutment |
| 24 | first guide rail base portion |
| 25 | first tongue |
| 26 | second guide rail base portion |
| 27 | second tongue |
| 28A & 28B | first and second restraining rods |
| 29 | handle portion |
| 30A & 30B | first and second handles |
| 31A & 31B | first and second restraining rod blocks |
| 32A & 32B | first and second triggers |
| 33A & 33B | restraining rod knobs |
| 34 | shield |
| 35 | threaded hole in tongue |
| 36 | shield attaching wall |
| 37 | tunnel in shield attaching wall |
| 38A–D | guide ridge adjusting slots |
| 39 | threaded hole in work advancing abutment |
| 40A–D | guide ridge locking bolts |
| 41A–D | guide ridge locking holes |
| 42A & B | shield retaining bolts |
| 43A & B | holes in shield |
| 44 | angular incrementation |
| 47A & B | shield retaining holes in triangle |
| 48 | length incrementation |
| 49 | length guide stop |
| 50 | hinge |
| 51A & B | flanges on shield |
| 52 | length guide stop retaining pin |
| 60 | table saw |
| 62A & B | channels |
| 64 | cutting blade |

-continued

| | |
|---|---|
| 80 | work piece |
| 90 | female receptacle |
| 92 | power cord |
| 94 | male end of power cord |
| 96 | live wire |

DETAILED DESCRIPTION OF THE PREFERRED EMBODIMENT

Referring to FIG. 1 in more detail, the drawing shows the angularly adjustable table saw jig 10 slidably mounted on a conventional table cutting saw 60 of the general class with which the invention is used most advantageously. Such table cutting saws have cutting tools such as the rotary cutting blade 64 protruding through a generally flat upper table face. The blade 64 is adapted to be rotated by a suitable power means (not shown) which is mounted normally beneath the saw table. On each side of the blade 64 there is provided a guide channel of substantially rectangular cross section. These channels are shown at 62A and 62B. The channels 62A and 62B are generally parallel to each other, and are parallel to the cutting path of the cutting blade 64. The present invention employs the channels 62A and 62B for slidably engaging the jig 10 to the table saw 60 so that the jig 10 follows a sliding path. This is done by the inclusion of laterally adjustable guide ridges 14A and 14B attached to the bottom of the jig 10, where guide ridges 14A, 14B comprise the means for slidably mounting the jig 10 on the upper flat table face of the table saw 60.

Figure 2:
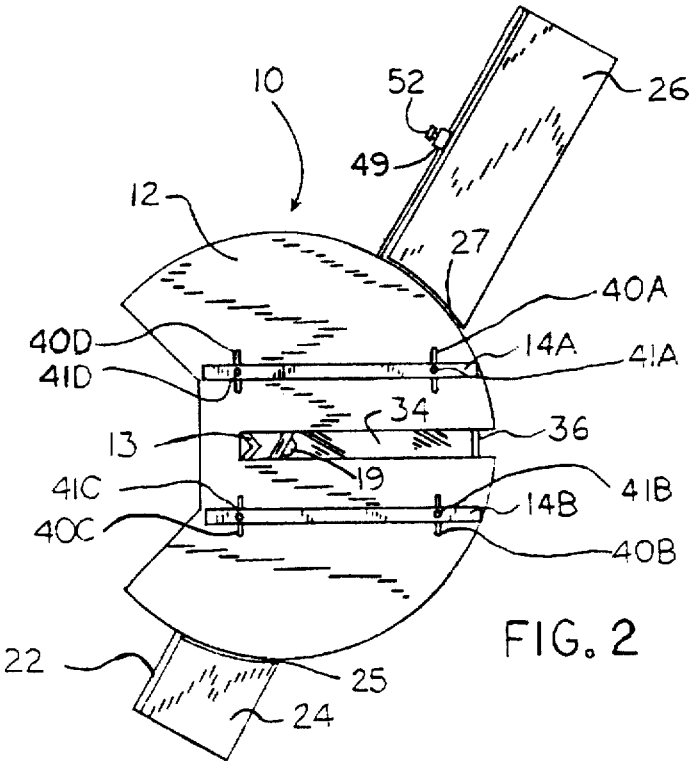
FIG. 2 is a bottom view of the jig of FIG. 1.
Figure 3:
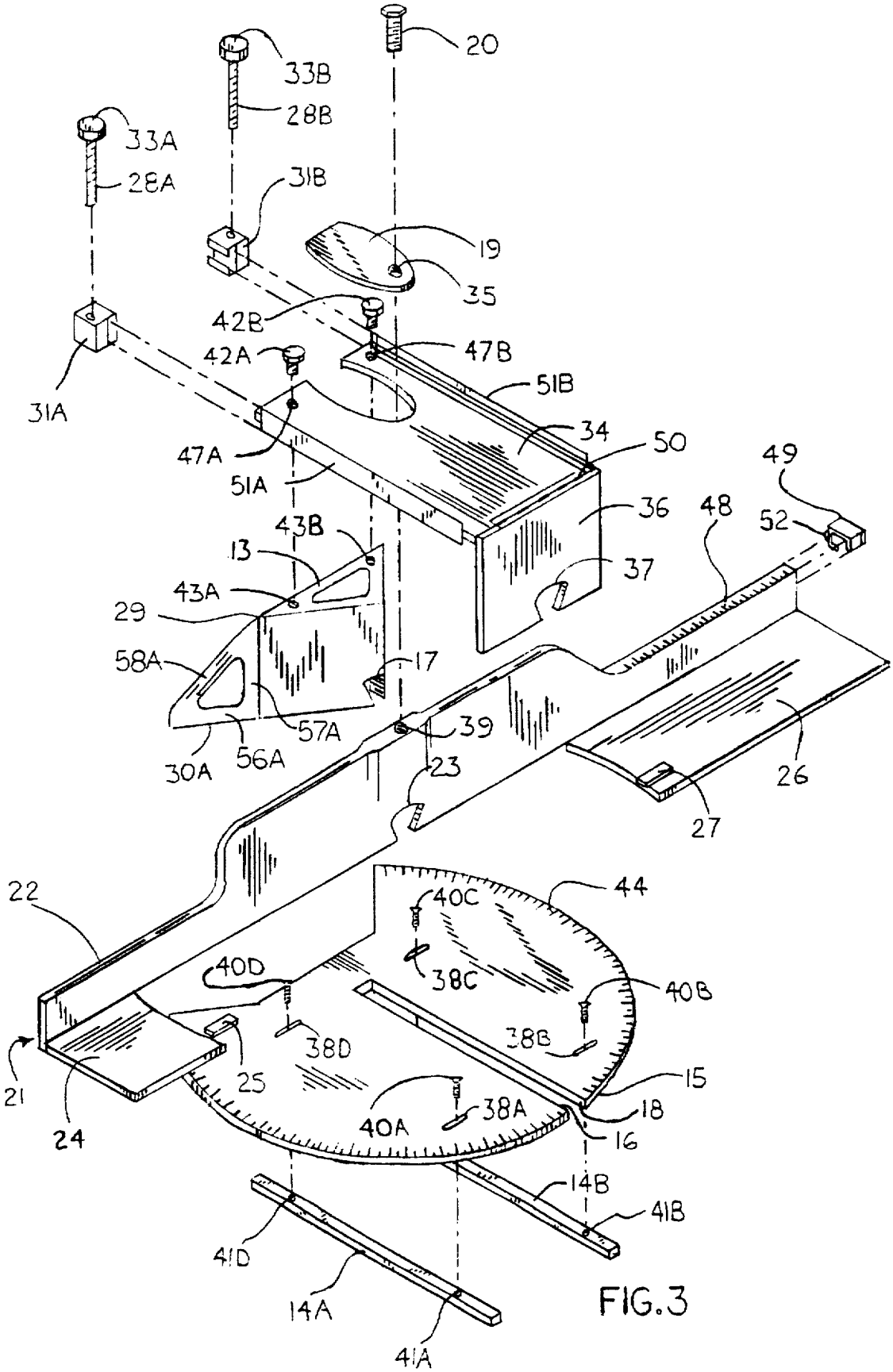
FIG. 3 is an exploded side view of the jig of FIG. 1.

Since just the ends of the ridges 14A and 14B are shown in FIG. 1, a better understanding of this aspect of the invention may be gained by reference to FIGS. 2 and 3. FIG. 2 is a bottom plan view of the jig 10. FIG. 3 is an exploded view of the jig 10. Together, the drawings show the ridges 14A and 14B to be long, narrow strips which travel substantially the length of the underside of the jig 10. The ridges 14A and 14B are sized to fit slidably within the channels 62A and 62B. The ridges 14A and 14B are attached to the jig 10 by threaded guide ridge locking bolts 40A, 40B, 40C, and 40D through laterally communicating guide ridge adjusting slots 38A, 38B, 38C, and 38D. The locking bolts 40A, 40B, 40C, and 40D project completely through the base plate 12 and into threaded guide ridge locking holes 41A, 41B, 41C, and 41D. The lateral position of one or both of the ridges 14A and 14B may be adjusted by placing the jig 10 on the table saw 60, loosening the locking bolts 40A, 40B, 40C, and 40D, adjusting the lateral spacing of the ridges 14A and 14B to align them with the channels 62A and 62B such that they slidably engage the channels 62A and 62B, and then tightening the locking bolts 40A, 40B, 40C, and 40D to lock the ridges 14A and 14B in place. With the ability to adjust laterally the spacing of the guide ridges 14A and 14B, the jig 10 may be used with table saws of various makes and sizes.

As is mentioned above, FIG. 3 illustrates the jig 10 in an exploded view. Consequently, it is able to show more clearly the various parts of the invention and how they come together. The jig 10 includes a base plate 12. In the preferred embodiment, the base plate 12 is generally round. However as FIG. 2 shows, it does not form a complete circle. Instead, there is an area the shape of a flat-nosed wedge removed therefrom. The wedge has two sides directed generally at the center of the base plate 12 and a nose which is generally perpendicular to a radial line drawn from the center of the base plate 12. Two handles 30A and 30B are mounted atop the base plate 12 along the two sides of the wedge area. The handles 30A and 30B project upwardly from the base plate 12 and provide means by which a user's hands may grasp and control the jig 10. In the preferred embodiment, each of the handles 30A and 30B are generally formed as right triangles with the right angle being at the inner end of the wedge's sides. First legs 56A and 56B adjacent to the right angle are attached to the base plate 12 and extend along the side of wedge to the periphery of the base plate 12, and second legs 57A and 57B are adjacent to the right angle and extend substantially vertically from the base plate 12. Third legs 58A and 58B extend from the periphery of the base plate 12 to connect the outer ends of the first legs 56A and 56B to the upper end of the second legs 57A and 57B. The legs of the handles 30A and 30B are constructed from a substantially rigid material and are sufficiently strong to allow the user to use the third, diagonally communicating legs 58A and 58B as grips to control and advance the jig 10.

An inner base triangle 13 is generally shaped like an equilateral triangle in horizontal cross section. It is rigidly connected to and projects upwardly from the base plate 12 to approximately the height of the uppermost portion of the handles 30A and 30B. Its two inner sides project along substantially the same path as the the handles 30A and 30B until the two inner sides meet. The third side of the base triangle 13 connects the outer ends of the inner sides as it communicates between the second legs of the handles 30A and 30B along the nose of the wedge in the base plate 12. The top of the inner base triangle 13 is substantially flat and lies in a plane which is substantially parallel to that of the base plate 12.

The inner base triangle 13 has rigidly attached to the top thereof a substantially rigid tongue 19. The tongue 19 extends inwardly from the triangle 13 to beyond the center of the base plate 12.

In the preferred embodiment, an axis bolt 20 passes downwardly towards the plane of the base plate 12 through the tongue 19 at a location generally above the center 4 curvature of the base plate 12. The axis bolt 20 projects into and acts as the axis of rotation for a guide rail 21 which advances work into the cutting blade 64. In the preferred embodiment, the guide 21 is comprised of a work advancing abutment 22 and first and second guide rail base portions 24 and 26. The work advancing abutment 22 is substantially perpendicular to the base plate 12. It communicates across generally the center of the base plate 12 where it is rotatably connected to the axis bolt 20 and proceeds radially therefrom. Under this arrangement, the work advancing abutment 22 can be rotated throughout a wide range of angles for cutting a work piece, which is shown in FIG. 1 in phantom at 80. With this, infinite adjustment of the angle to which work pieces are cut may be accomplished by selectively rotating the work advancing abutment 22.

Referring again to FIG. 1, one will note that first and second guide rail base portions 24 and 26 for supporting work pieces also are included in the preferred embodiment. The base portions 24 and 26 are rigidly connected substantially perpendicularly to the work advancing abutment 22 at the base thereof such that they are located in substantially the same plane as the base plate 12. Under this arrangement, the work piece 80 enjoys a flat support surface extending beyond the periphery of the base plate 12. The first base portion 24 extends radially from the periphery of the base plate 12. Its inner end is arcuate with a radius of curvature substantially identical to that of the base plate 12.

Likewise, the second base portion 26 extends radially from the opposite edge of the base plate 12 with its inner end arcuate with a radius of curvature substantially identical to that of the base plate 12. With this, a substantially continuous work piece supporting surface is provided. It is preferred that the base portions 24 and 26 further include tongues 25 and 27. The tongues 25 and 27 are fixedly attached to the inner ends of each of the base portions 24 and 26 opposite the work advancing abutment 22. The tongues 25 and 27 extend from the base portions 24 and 26 to overlap with the edge of the base plate 12 and thereby serve to stabilize further the guide rail 21 from torsional rotation.

What may be called for ease of discussion the front of the base plate 12 is generally indicated at 15 in FIG. 3. From the front 15 of the base plate 12, there is a slot formed by sides 16, 18 cut into the base plate 12 to accommodate the cutting blade 64 when the base plate 12 is slid over the upper face of the table saw 60, this movement being guided by the cooperation of the ridges 14A and 14B and the channels 62A and 62B. The slot 16–18 continues from the front 15 of the base plate 12 through the center of the base plate 12 and therebeyond to allow travel of the cutting blade 64 to and beyond the work advancing abutment 22 as work is advanced into the cutting blade 64 by the sliding movement of the jig 10. Consequently, it becomes clear that the axis of rotation of the guide rail 21, which in this preferred embodiment is fixed at the axis bolt 20, is coincident with a cutting plane of the cutting blade 64.

Since the jig 10 must slide over the cutting blade 64, provisions must be made to allow the blade 64 to pass through the jig 10 unobstructed. On this note, those skilled in the art may realize that the cutting blade 64 must pass beyond the work advancing abutment 22 to allow for the complete cutoff of the work piece 80. Further and for the same reason, it may be necessary for the cutting blade 64 to pass beyond the tip of the inner base triangle 13. Consequently, the work advancing abutment 22 and the tip of the inner base triangle 13 have open areas removed therefrom which are located directly over the slot 16–18. The open areas each define what may be called tunnels. These are shown at 23 and 17 for the work advancing abutment 22 and the triangle 13 respectively. In this preferred embodiment, the tunnels 23 and 17 are shaped generally like a piece of pie, such as would result from the removal of material by the cutting blade 64 passing through the work advancing abutment 22 and the triangle 13. Stated alternatively, the tunnel 23 is defined by a first side corresponding to the position of the cutting blade 64 when tilted as far as possible in one direction, a second side corresponding to the position of the cutting blade 64 when tilted as far as possible in the opposite direction, and an arcuate top corresponding to the many intermediary positions of the cutting blade 64.

For additional safety, the preferred embodiment includes a substantially transparent, elevated shield 34. The shield 34 is supported at a first end by the top of the inner base triangle 13. It is supported at a second end by a shield attaching wall 36 which is attached to nearly the front 15 of the base plate 12. The shield attaching wall 36 is generally rectangular and planar and extends substantially vertically from the base plate 12 to a height substantially equal to the height of the inner base triangle 13 whereby the shield 34 is maintained in a plane of orientation which is generally parallel to the base plate 12. To allow the cutting blade 64 to pass therethrough, the shield attaching wall 36 has a tunnel 37 at the base thereof. The tunnel 37 is shaped similarly to tunnels 23 and 17 and is centered directly over the slot 16–18.

To allow access to the cutting area of the jig 10, the second end of the shield 34 is rotatably connected to the shield attaching wall 36 by a hinge 50. To prevent movement of the shield 34 during the cutting operation, the first end of the shield 34 is detachably secured to the inner base triangle 13 by threaded engaging bolts 42A and 42B. Each bolt 42A and 42B is provided with a handle which may be turned by hand. Rotation of the handles drive the screws 42A and 42B into respective threaded holes 47A and 47B in the top of the inner base triangle 13.

Since it is contemplated in the preferred embodiment that both the axis retaining tongue 19 and the shield 34 are attached to the top of the inner base triangle 13, the two are designed to accommodate each other as the figures show. The tongue 19 is shaped, as one might expect, like a tongue while the shield 34 has a corresponding area removed therefrom such that the two may fit together in a complementary manner. As a result of the transparent shield 34, a craftsperson can grasp the handles 30A and 30B and advance the jig 10 into the cutting blade 64 and monitor the cutting process while being shielded from flying debris and like dangers which the cutting process otherwise might present.

Figure 4:
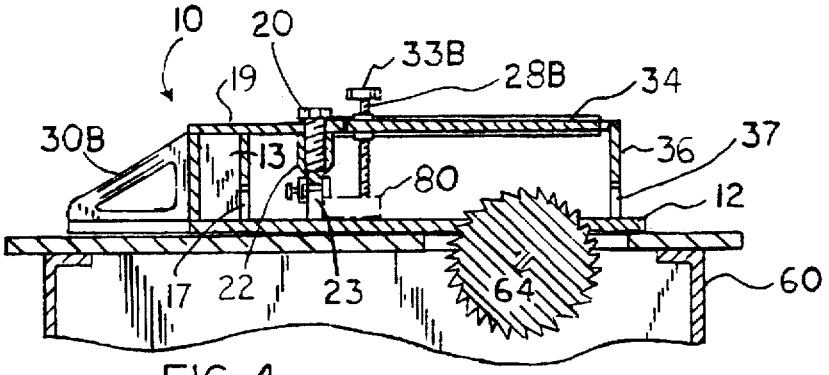
FIG. 4 is a side elevational view of the jig and of the table rotary cutting tool taken along the line 4—4 in FIG. 1.

During the cutting process, the cutting blade 64 and other similar forces tend to cause the work piece 80 to move. Such movement is undesirable as it lessens the accuracy of the resulting cut, tends to waste material, and presents those around the machine with the danger of work pieces or portions thereof ejecting from the cutting area in a projectile-like manner. The present invention remedies that problem by providing two threaded work piece restraining rods 28A and 28B. As such, the restraining rods 28A and 28B each act as a means for restraining a work piece 80. As FIG. 4 and the other figures show, the restraining rods 28A and 28B depend downwardly toward the base plate 12 through threaded holes in restraining rod blocks 31A and 31B.

Figure 6:
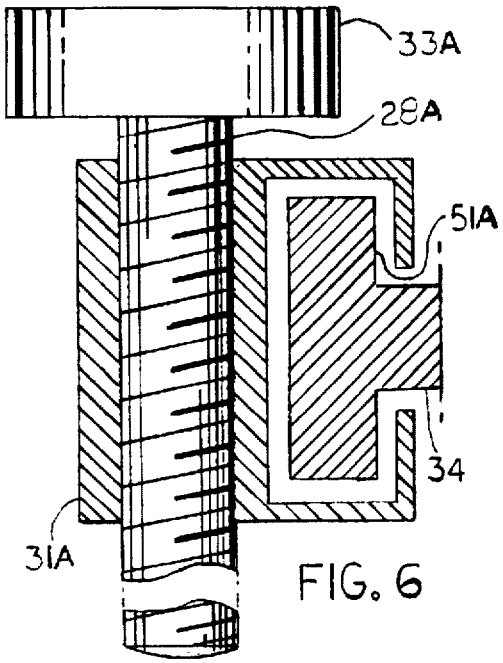
FIG. 6 is a sectional view of the work piece restraining means included in the preferred embodiment taken along the line 6—6 in FIG. 1.

Adjusting the angle to which a work piece 80 may be cut may require movement of the restraining rods 28A, 28B, and an operator may wish to move the restraining rods 28A, 28B to suit the size of the work piece to be cut. For these and similar reasons, the restraining rods 28A and 28B are slidable longitudinally with respect to the shield 34. Referring to FIGS. 3 and 6, one will note that the preferred embodiment of the invention includes longitudinally communicating flanges 51A and 51B on the shield 34. The restraining rod blocks 31A and 31B have a claw-like cross section which allows them to grip and to slide along the flanges 51A and 51B when the restraining rods 28A and 28B are not restraining a work piece. However, when the rods 28A and 28B are pressed against a work piece, the restraining force tends to press the blocks 31A and 31B upward to press against the flanges 51A and 51B. With this, the blocks 31A and 31B are frictionally engaged to the flanges 51A and 51B and will not move until the rods 28A and 28B are rotated up and away from the workpiece 80.

As the figures show, the restraining rods 28A and 28B are located on the shield 34 such that they secure a work piece on opposing sides of the slot 16–18 and thereby restrain the work piece 80 on both sides of the cutting blade 64. When the work piece 80 is severed in two, both of the resulting pieces are held in place without need for manual intervention. The result is a safer, smoother, and more accurate cut than is obtainable otherwise.

Figure 7:
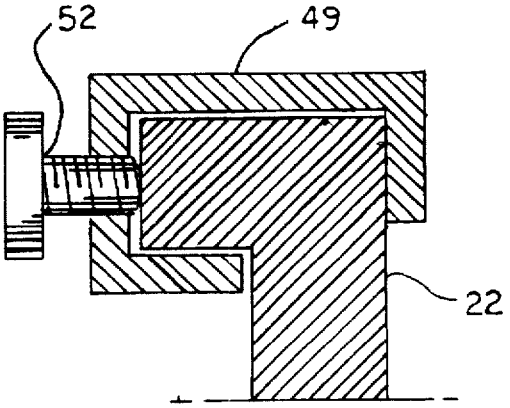
FIG. 7 is a sectional view of the work piece length measuring means included in the preferred embodiment taken along the line 7—7 in FIG. 1.

To aid in the accurate measurement of the angles to which work pieces are cut by the jig 10, there is included in the preferred embodiment angular incrementation 44 which is disposed on the periphery of the base plate 12. The scale 44 maybe provided integrally by imprinting, etching, or any other suitable method. Similarly, the jig 10 includes a means for measuring and maintaining consistency in the length to which work pieces are to be cut. Referring to FIGS. 3 and 7, a measuring and stop means comprises a length guide stop 49 which slides longitudinally along the work advancing abutment 22. By rotating in a given rotational direction a length guide retaining pin 52, the guide stop 49 is locked in place. As FIG. 3 shows, the guide stop 49 may be slid along the work advancing abutment 22 to cut the work piece 80 to a length indicated by length incrementation 48 which is provided on the upper edge of the work advancing abutment 22. With the guide stop 49 locked in place, work piece 80 may be butted up against the stop 49 to be cut to the proper length. By use of the guide stop 49, a user may measure accurately the length to which work pieces will be cut. Furthermore, the operator may achieve consistent lengths when multiple, similarly-lengthed pieces are desired.

Figure 5:
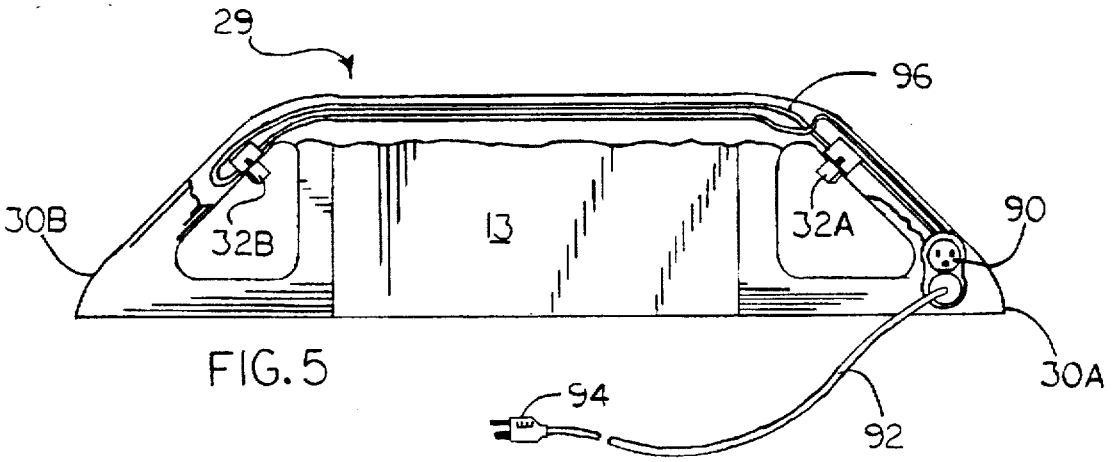
FIG. 5 is a rear elevational view of the handle portion of an alternative embodiment of the jig.

FIG. 5 shows just the handle portion 29 of an alternative embodiment of the jig 10. The figure depicts an additional safety feature, namely a means for sensing the presence of an operator's hands, which causes the table saw 60 to not operate when the user's hands are not both gripping the handles 30A and 30B. More particularly, the jig 10 may be constructed to act as an intermediary between the power source and the table saw 60 wherein the male end of the table saw 60's power cord is plugged into a female receptacle 90 on the first handle 30A of the jig 10. From the first handle 30A, there extends a power cord 92 which has a male end 94. The male end 94 may be plugged into any traditional power source. Within the handle portion 29, a live wire 96 leads up to the first trigger 32A from the power cord 92. At the trigger, there is a gap in the live wire 96 which is closed only when the trigger 32A is pressed in fully. From the first trigger 32A, the live wire 96 communicates across the inner base triangle 13 to the second trigger 32B on the second handle 30B. Again, there is a gap in the live wire 96 which is closed only when the trigger 32B is pressed in fully. From the trigger 32B, the live wire communicates back across the inner base triangle 13 to the female receptacle 90. Under this arrangement, the electrical circuit is completed only when both of the triggers 32A and 32B are squeezed. By this contrivance, the jig 10 ensures that both of a user's hands are clear of the cutting area before allowing power to reach the blade 64.

To use the invention, assuming one has a table saw similar to the one shown at 60 in FIG. 1 and an embodiment of the invention as described above, one might start by adjusting the guide ridges 14A and 14B to suit the particular table saw to be used. To do so, one would loosen the guide ridge locking bolts 40A–D, slide the guide ridges 14A and 14B to positions corresponding to the channels 62A and 62B, and then tighten the locking bolts 40A–D. Next, one would need to connect the power source by plugging the male end 94 of the table saw's 60 power cord into the female receptacle 90 on the first handle 30A and plugging the male end 94 of the jig's 10 power cord 92 into a traditional power source. Having done so, one could next adjust the angle to which the work piece 80 would be cut by gripping and rotating the guide rail 21 to the desired angle as indicated by the angular incrementation 44.

With the appropriate angle set, one would next set the guide stop 49 to the appropriate length and lock it in place by turning the retaining pin 52. One would next loosen the shield retaining bolts 42A and 42B, raise the shield 34 to an open position, and insert a work piece 80 such that it butts up against the stop 49. The next steps would be to close the shield 34 and to tighten the shield restraining bolts 42A and 42B to lock the shield 34 in place. With that, one would slide the work piece restraining rods 28A and 28B to appropriate positions along their respective flanges 51A and 51B, and then tighten them down to secure the work piece 80 in place. With the work piece 80 appropriately positioned and secured, one would grip the handles 30A and 30B and press in the triggers 32A and 32B to send power to the saw 60 and start the blade 64 spinning. Using the handles 30A and 30B, one would slide the jig 10 along the channels 62A and 62B such that the blade 64 completely severs the work piece 80. With the work piece 80 cut to the desired length and angle, one would slide the jig 10 back to its original position and let go of the handles 30A and 30B to cut off power to the saw 60. One would then loosen the restraining rods 28A and 28B and the shield restraining bolts 42A and 42B, open the shield, and remove the work piece 80 which has been cut safely to a desired length and angle.

From the foregoing, it is apparent that the present invention has many advantages. These include providing a jig for use on table cutting tools which supplants the need for specialized mitering tools. The invention does so by enabling a table saw to perform the mitering tool's functions with no corresponding sacrifice in performance. To do so, the invention provides a universally adaptable jig which may be adjusted over a wide range of angles simply and accurately by virtue of the rotatably connected guide rail. The jig's accurate and consistent guidance of work pieces is aided by the provision of a length guide stop and appropriately situated angular and length incrementation. Also, the accuracy provided by the guide rail is improved further by a work piece restraining means. The restraining means also provides added safety by preventing unwanted movement of the work piece. The safety of the jig is enhanced further by an elevated shield means which prevents harm to the user from the saw blade and flying debris. The safety of the invention is improved still further by a safety cutoff mechanism which prevents power from flowing to the table saw if the user does not have both hands on the handles of the jig.

Although the invention has been shown and described with reference to a certain preferred example, those skilled in the art can conceive of alternative embodiments. For instance, those with the major features of the invention in mind could craft embodiments of the invention which incorporate those major features while not incorporating all of the features included in the preferred embodiment. With this in mind, the following claims are intended to define the scope of protection to be afforded the inventor, and the claims shall be deemed to include equivalent constructions insofar as they do not depart from the spirit and scope of the present invention.

I claim as my invention:

1. A jig for feeding work to a table cutting saw, the table cutting saw with a cutting blade projecting through a generally flat upper table face, and the jig comprising:

a base plate with an underside and an upper flat surface for supporting a work piece;

a means for slidably mounting the jig on the upper table face of the table cutting saw for enabling the jig to slide along a jig sliding path, wherein the jig sliding path is parallel to a cutting path of the cutting blade;

an elongated guide rail for advancing a work piece into the cutting blade, wherein the guide rail is rotatably connected to the base plate for rotation of the guide rail about a single axis of rotation, wherein the axis of rotation of the guide rail is fixed with regard to the jig, and wherein the axis of rotation of the guide rail is coincident with a cutting plane of the cutting blade; and a slot in the base plate wherein the slot is generally parallel to the sliding path of the jig for providing clearance for the cutting blade when the base plate is slid over the upper table face of the table cutting saw.

2. The jig of claim 1 wherein the table cutting saw has at least one guide channel disposed on the upper table face of the table cutting saw, and the slidably mounting means of the jig comprises at least one guide ridge attached to the underside of the base plate parallel to the cutting path of the cutting blade, wherein the guide ridge is slidably engaged with the guide channel for maintaining accurate alignment of the base plate as the base plate is slid over the upper table face of the table cutting saw.

3. The jig of claim 1 further comprising a unitary and generally planar shield connected to the jig for protecting an operator from the cutting blade and from debris flying up from the cutting blade, wherein the shield is oriented in a plane generally parallel to and displaced from the upper flat surface of the base plate.

4. The jig of claim 3 wherein the shield is connected to the base plate.

5. The jig of claim 3 wherein the shield is of a transparent material whereby a user can monitor the cutting blade as the cutting blade cuts a work piece.

6. The jig of claim 3 further comprising a means for restraining work pieces connected to the jig.

7. The jig of claim 6 wherein the work piece restraining means comprises at least one rod for directly engaging a work piece, wherein the rod passes through and projects from the elevated shield toward the upper flat surface of the base plate, and the jig further comprising a means for selectively extending the at least one rod toward the upper flat surface of the base plate and into restraining engagement with a work piece and a means for retracting the at least one rod to release a work piece.

8. The jig of claim 1 further comprising angular incrementation disposed on the base plate.

9. The jig of claim 1 further comprising a guide stop slidably attached to the guide rail and length incrementation disposed on the guide rail.

10. A jig for feeding work to a rotary table cutting saw, the table cutting saw with a rotary cutting blade projecting through a generally flat upper table face, and the jig comprising:

a generally circular base plate forming at least a substantial portion of a circle, wherein the base plate has a single center of curvatures an underside, and an upper flat surface for supporting a work piece;

a means for slidably mounting the jig on the upper table face of the table cutting saw for allowing the jig to slide along a jig sliding path, wherein the jig sliding path is generally parallel to a cutting path of the cutting blade;

an elongated and upwardly projecting guide rail for advancing work into cutting engagement with the rotary cutting blade, wherein the guide rail is rotatably connected to the base plate about a single axis of rotation, and wherein the axis of rotation of the guide rail is fixed generally at the center of curvature of the base plate and coincident with a cutting plane of the cutting blade; and a slot in the base plate wherein the slot is generally parallel to the jig sliding path for providing clearance for the cutting blade when the base plate is slid over the upper table face of the table cutting saw.

11. The jig of claim 10 wherein the table cutting saw has at least one guide channel disposed on the upper table face of the table cutting saw, and the slidably mounting means of the jig comprises at least one guide ridge attached to the underside of the base plate parallel to the cutting path of the cutting blade, wherein the guide ridge is slidably engaged with the guide channel for maintaining accurate alignment of the base plate as the base plate is slid over the upper table face of the table cutting saw.

12. The jig of claim 10 further comprising a unitary generally planar shield connected to the jig for protecting an operator from the cutting blade and from debris flying up from the cutting blade, wherein the shield is oriented in a plane generally parallel to and displaced from the upper flat surface of the base plate.

13. The jig of claim 12 wherein the shield is transparent whereby the operator of the jig can monitor the cutting blade as the cutting blade cuts a work piece, and wherein the shield is rotatably connected to the jig at a first end of the shield whereby the shield may be rotated to an open position.

14. The jig of claim 10 further comprising a means for restraining a work piece, wherein the restraining means is fixedly attached to the jig.

15. The jig of claim 12 further comprising at least one work piece restraining rod for directly engaging a work piece, wherein the rod passes through and projects from the elevated shield toward the upper flat surface of the base plate for restraining a work piece, and the jig further comprising a means for selectively extending the at least one rod toward the upper flat surface of the base plate and into restraining engagement with a work piece and a means for retracting the at least one rod to release a work piece.

16. The jig of claim 15 wherein two restraining rods each project, from the elevated shield toward the upper flat surface of the base plate, on opposing sides of the slot.

17. The jig of claim 10 wherein the guide rail rotates about an axis bolt, wherein the axis bolt is connected to and extends downwardly from an axis bolt retaining tongue, wherein the axis bolt retaining tongue is rigidly connected to a handle portion and extends over generally the center of curvature of the base plate from the handle portion, and wherein the handle portion is rigidly connected to and extends upwardly from the base plate.

18. The jig of claim 17 wherein the handle portion includes two handles for aiding an operator in gripping and controlling the jig.

19. The jig of claim 10 further comprising angular incrementation disposed on the base plate.

20. The jig of claim 10 further comprising a guide stop slidably attached to the guide rail and length incrementation disposed on the guide rail.

* * * * *